US006755556B2

(12) United States Patent
Gasquet et al.

(10) Patent No.: US 6,755,556 B2
(45) Date of Patent: Jun. 29, 2004

(54) INDICATOR LIGHT COMPRISING AN OPTICAL PIECE FULFILLING AN INDICATING FUNCTION AUTONOMOUSLY

(75) Inventors: Jean-Claude Gasquet, Bobigny Cedex (FR); Manuel Panay, Bobigny Cedex (FR)

(73) Assignee: Valeo Vision, Bobigny Cedex (FR)

( * ) Notice: Subject to any disclaimer, the term of this patent is extended or adjusted under 35 U.S.C. 154(b) by 0 days.

(21) Appl. No.: 10/371,305

(22) Filed: Feb. 21, 2003

(65) Prior Publication Data

US 2003/0156417 A1 Aug. 21, 2003

(30) Foreign Application Priority Data

Feb. 21, 2002 (FR) ..... 0202220

(51) Int. Cl.[7] ..... F21V 5/00; F21V 7/04

(52) U.S. Cl. ..... 362/329; 362/328; 362/336; 362/337; 362/338; 362/339; 362/340

(58) Field of Search ..... 362/328, 327, 362/329, 332, 333, 336, 337, 334, 338, 339, 340

(56) References Cited

U.S. PATENT DOCUMENTS

| | | | | |
|---|---|---|---|---|
| 2,254,961 A | | 9/1941 | Harris | 240/106.1 |
| 3,821,590 A | | 6/1974 | Kosman et al. | 313/499 |
| 5,704,709 A | | 1/1998 | Zwick et al. | 362/304 |
| 5,894,196 A | * | 4/1999 | McDermott | 313/512 |
| 6,244,731 B1 | * | 6/2001 | Koiko et al. | 362/297 |
| 6,547,423 B2 | * | 4/2003 | Marshall et al. | 362/333 |

FOREIGN PATENT DOCUMENTS

| | | |
|---|---|---|
| DE | 197 28 354 | 1/1999 |
| EP | 1 118 813 | 7/2001 |
| FR | 2 507 741 | 12/1982 |
| WO | 02/33449 | 4/2002 |

* cited by examiner

*Primary Examiner*—Thomas M. Sember
(74) *Attorney, Agent, or Firm*—Morgan & Finnegan, LLP

(57) ABSTRACT

The invention proposes an indicator light, in particular for a motor vehicle. The indicator light includes a central optical axis, a light source and a solid optical piece. The solid optical piece includes at least (1) an input face whose generatrix lies in a direction substantially parallel to the optical axis, (2) a rear reflection face whose generatrix lies in a direction substantially inclined towards the front, and (3) a front exit face. The exit face is formed by a series of elementary distribution dioptric elements, each of which is designed to form an elementary light beam whose image, on a screen placed in front of the indicator light, corresponds to the indicating function to be fulfilled.

15 Claims, 5 Drawing Sheets

INDICATOR LIGHT COMPRISING AN OPTICAL PIECE FULFILLING AN INDICATING FUNCTION AUTONOMOUSLY

FIELD OF THE INVENTION

The invention proposes an indicator light in particular for a motor vehicle.

BACKGROUND OF THE INVENTION

The invention proposes more particularly an indicator light, in particular for a motor vehicle, of the type comprising a central optical axis oriented from rear to front, a light source roughly at one point disposed on this optical axis, and a solid optical piece, at least partly of revolution about the optical axis, which is produced from a transparent material with a refractive index greater than that of air and which is arranged at the front of the source, of the type in which the optical piece comprises at least:

an input face whose generatrix lies in a direction substantially parallel to the optical axis;

a rear reflection face whose generatrix lies in a direction substantially inclined towards the front;

and a front exit face;

so that the light flux emitted by the source and entering the optical piece through the inlet face is reflected on the rear reflection face, according to the principal of total reflection, and is returned towards the front exit face in a direction roughly parallel to the optical axis, with a view to fulfilling a given indicating function.

This type of indicator light is already known, in particular through the document FR-A-2.507.741 and fulfils the indicating functions which are defined by current regulations.

The indicating functions of a vehicle light must comply with regulations which define specific photometric conditions for each indicating function to be performed.

For example, according to the regulations currently in force in Europe, an indicator light fulfilling a fog light function must form, on the measuring screen placed at ten meters, an image which has roughly a diamond shape.

This diamond is defined by characteristic points which are arranged on the measuring screen and which must each receive a light intensity whose value must be in a given range.

In the same way, an indicator light fulfilling a reversing light function must form, on the measuring screen, a rectangle of given dimensions whose length is parallel to the horizontal plane.

An indicator light of the type described in the document FR-A-2.507.741 generally requires several optical pieces for fulfilling the required indicating function. For example, a first optical piece, or flux recoverer, is provided for recovering the light flux emitted by the source and concentrating it on the rear face of a second optical piece, or flux diffuser, which is placed axially at the front of the flux recoverer.

The flux diffuser is designed to spatially distribute the light flux forwards so as to form a light beam whose image, on a measuring screen placed at ten meters, matches the image of the function to be fulfilled, for example a diamond for a fog light function according to European regulations or a horizontally stretched rectangle for a reversing light function.

The invention aims in particular to reduce the number of parts necessary for fulfilling a given indicating function and to reduce the size of the indicator light.

SUMMARY OF THE INVENTION

For this purpose, the invention proposes an indicator light of the type described above, characterised in that the exit face is formed by a series of elementary distribution dioptric elements, each of which is designed to form an elementary light beam whose image, on a screen placed in front of the indicator light, corresponds to the indicating function to be fulfilled.

According to other characteristics of the invention:

each elementary dioptric element extends roughly in a radial plane, and the elementary dioptric elements form a mesh;

the dioptric elements are arranged in rings around the optical axis, and each dioptric element extends over an angular ring portion;

the optical piece comprises several rear reflection faces which are stepped axially and radially;

the optical piece comprises several entry faces which are stepped axially towards the rear and radially from the optical axis towards the outside;

the optical piece comprises a central portion, at least partly of revolution about the optical axis, which is arranged axially to the front of the light source and which comprises at least one rear entry face which is designed to divert the incoming light flux, according to the refraction principle, in order to return it, in a direction substantially parallel to the optical axis, to a central front exit face associated with the optical piece, designed to form a light beam corresponding to the indicating function to be fulfilled;

at least one part of the central portion is a lens;

the optical piece comprises a substantially cylindrical rear housing coaxial with the optical axis in which the light source is arranged;

the optical piece comprises several annular rear reflection faces which are stepped axially towards the front and radially from the optical axis towards the outside, two adjacent rear reflection faces being separated by an optically neutral annular rear face arranged outside the path of the light flux which has just been reflected on the said rear reflecting faces;

the optical piece comprises several annular front exit faces which are stepped axially towards the front and radially from the optical axis towards the outside;

the rear face of the optical piece has roughly the shape of a spherical cap centred on the optical axis;

the light source is a light-emitting diode;

the optical piece is produced in a single piece, in particular by plastic moulding.

Other characteristics and advantages of the invention will emerge from a reading of the following detailed description, for an understanding of which reference will be made to the accompanying drawings, amongst which:

DESCRIPTION OF THE PREFERRED EMBODIMENTS

Figure 1:
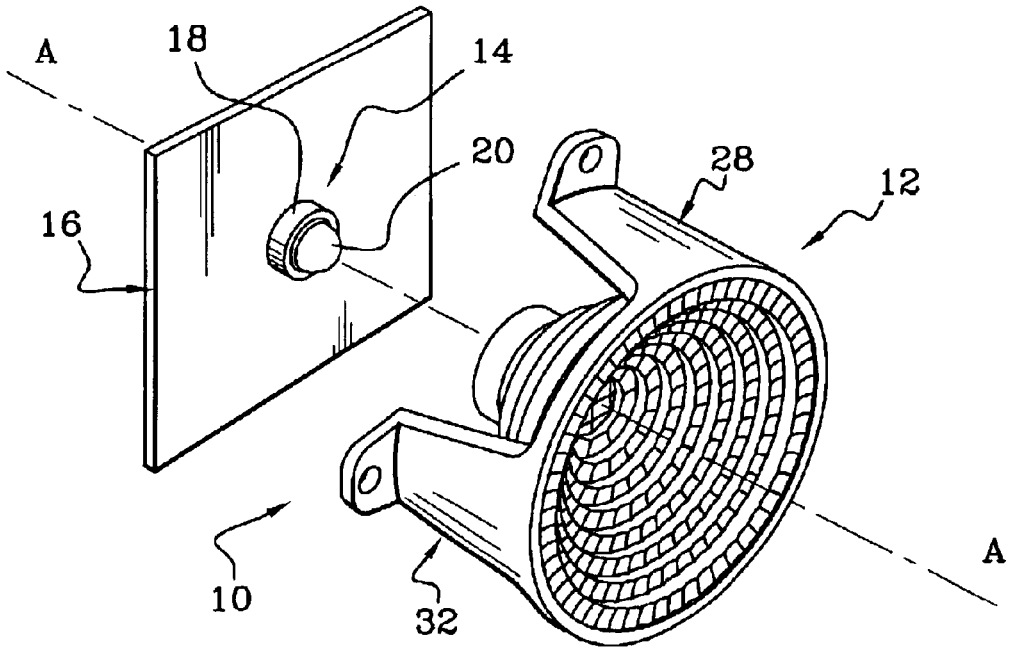
FIG. 1 is an exploded three-quarters front perspective view which depicts the indicator light according to a first embodiment of the invention.

In the following description, substantially identical or similar elements will be designated by identical references.

FIGS. 1 to 7 depict an indicator light 10 which is produced in accordance with a first embodiment of the invention.

This indicator light 10 comprises a solid optical piece 10 which serves both as a light flux recoverer and a light flux diffuser for a light source consisting here of a light-emitting diode 14.

The diode 14 has been depicted mounted on a support plate 16 which enables it in particular to be connected to an electrical supply system and to a control unit (neither of which are shown).

Advantageously a so-called high-power diode 14 is used, that is to say a diode whose light power is several tens of lumens, for example greater than 30 lumens, which is to be compared with the power of less than 10 lumens of so-called low-power diodes.

The high-power diodes 14 are available in several colours, that is to say it is possible to choose the colouring of the light flux emitted by the diode 14. The colour of the diode 14 is preferably chosen according to the indicating function to be fulfilled, for example red for a fog light function or white for a reversing light function.

Figure 6:
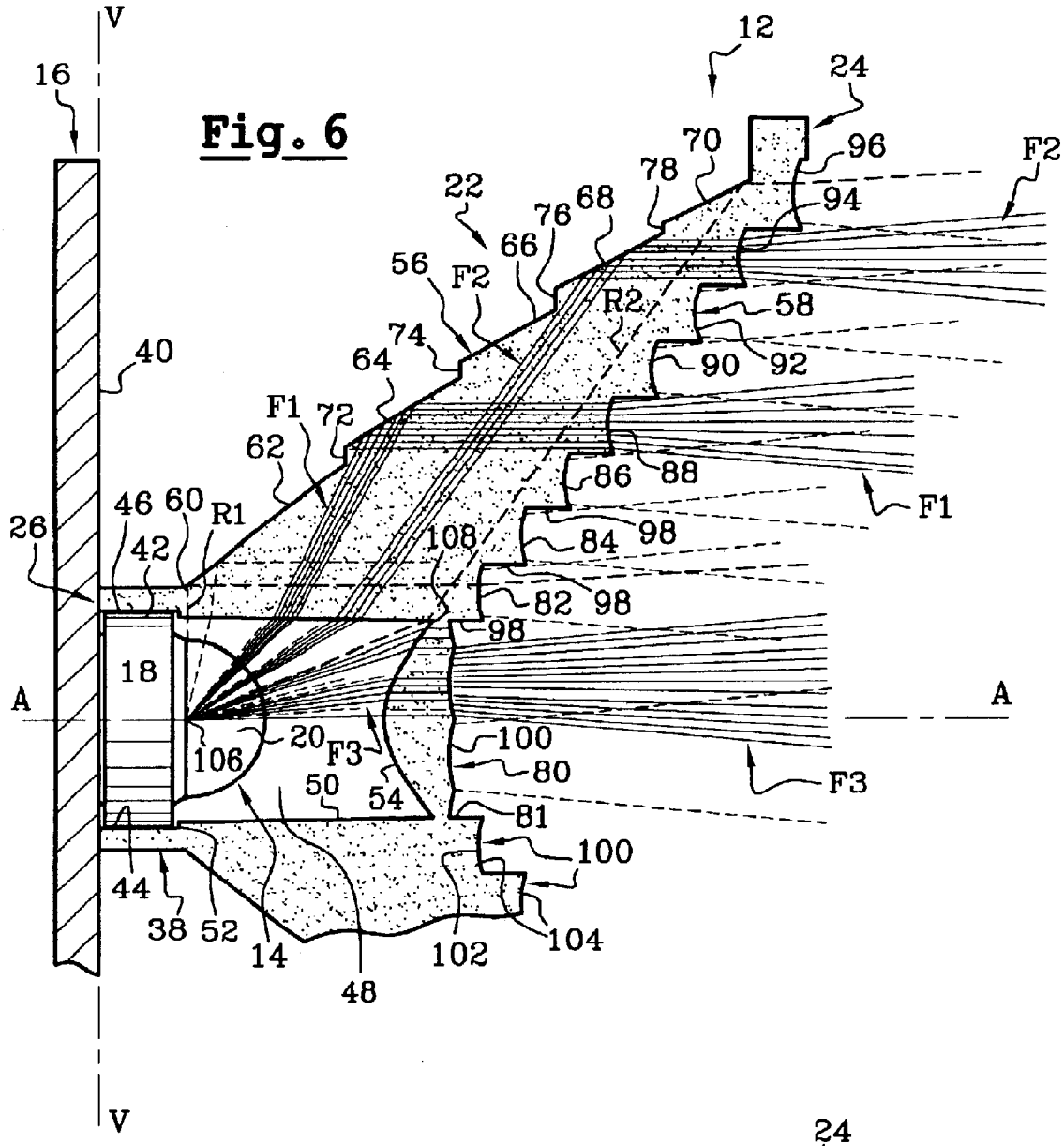
FIG. 6 is a partial enlarged view in axial section, along the cutting plane 6—6 in FIG. 2, which illustrates the path of the light rays emitted by the light-emitting diode of the indicator light of FIG. 1.

The optical piece 12 and the diode 14 are arranged coaxially on a central optical axis A—A which extends roughly horizontally from left to right, as seen in FIG. 6.

In the remainder of the description use will be made, non-limitingly, of an axial orientation from rear to front which corresponds to an orientation from left to right along the optical axis A—A, as seen in FIG. 6.

Non-limitingly, elements will be termed external or internal depending on whether they are arranged radially towards the optical axis A—A or opposite to this axis.

Referring in particular to FIG. 1, it can be seen that the diode 14 comprises at the rear a substantially cylindrical connection box 18 and at the front a substantially hemispherical globe 20 centred on the optical axis A—A.

The connection box 18 comprises fixing and electrical connection means (not shown) for mounting the diode 14 on the plate 16.

The optical piece 12 is produced from a transparent material having a refractive index greater than that of air, which constitutes here the ambient environment surrounding the piece 12.

Advantageously the optical piece 12 is produced in a single piece by moulding in a transparent plastics material such as for example polymethyl methacrylate (PMMA).

Figure 2:
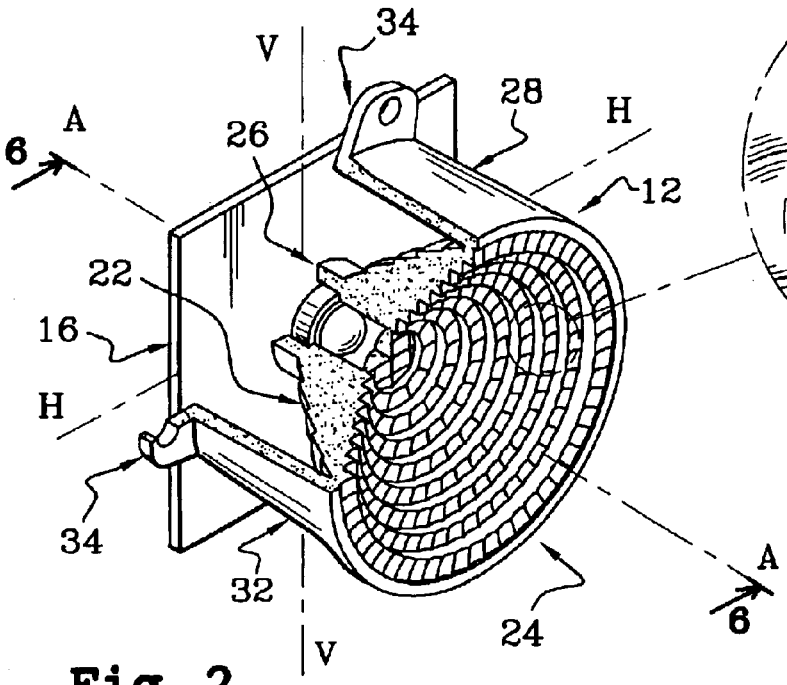
FIG. 2 is a three-quarter front perspective view, with cutaway, which depicts the indicator light of FIG. 1.
Figure 4:
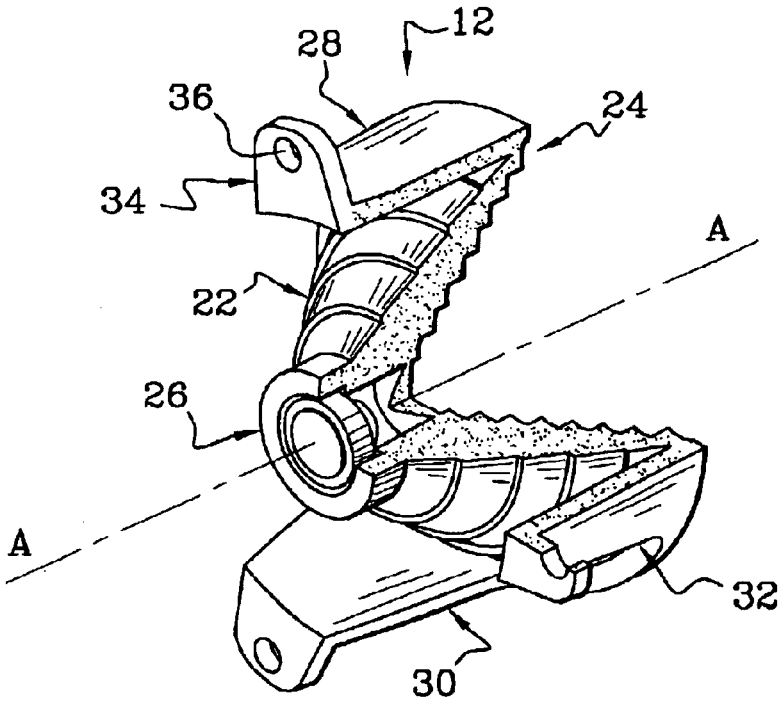
FIG. 4 is a three-quarter rear perspective view, with cutaway, which depicts the indicator light of FIG. 1.

As can be seen in particular in the views with cutaway in FIGS. 2 and 4, the optical piece 12 comprises a main body 22 which has roughly a frustoconical shape, partially hollow at the front, whose base forms its front axial end 24 and whose stop forms its rear axial end 26.

The optical piece 12 comprises here three fixing lugs 28, 30, 32 which extend axially towards the rear, from the front axial end 24 of the main body 22.

These three lugs 28, 30, 32 are here distributed angularly in a regular manner and comprise, at their rear axial end, a support portion 34 which extends towards the outside in a substantially radial plane and which comprises an axial hole 36. The hole 36 is aimed at allowing the fixing of the optical piece 12 to a support (not shown) for the light 10, by means of a fixing system of a known type, for example by screwing.

The fixing lugs 28, 30, 32 serve to hold the optical piece 12 on a support for the light 10 and they must retain the optical piece 12 axially and radially with respect to the light source, here the diode 14.

The fixing of the optical piece 12 to a support does not necessarily require the lugs 28, 30, 32 to comprise a hole 36. This is because the lugs 28, 30, 32 can be fixed directly to the support by crimping or ultrasonic welding.

The main body 22 of the optical piece 12 is here a shape of revolution about the optical axis A—A.

Referring in particular to FIG. 6, it can be seen that the main body 22 comprises a tubular portion 38 at its rear axial end 26. This tubular portion 38 forms a strut which guarantees in particular that, when the optical piece 12 is mounted in axial abutment against the front face 40 of the plate 16, the main body 22 is not in axial abutment against the diode 14, which might damage it.

The tubular portion 38 also serves to centre the diode 14, in a radial plane, with respect to the optical piece 12. To this end, the tubular portion 38 comprises for example three axial centring ribs 42, or knurls, on its internal face 44, which cooperate with the cylindrical wall 46 of the connection box 18 of the diode 14.

According to a variant embodiment (not shown), the tubular portion 38 can comprise axial spikes which are received in complementary holes produced opposite in the support.

The main body 22 comprises, in its rear axial end 26, a housing 48 which is designed to receive the globe 20 of the diode 14 axially. More precisely, the diode 14 is arranged in the housing 48 so that its globe 20 extends entirely inside the housing 48.

In FIG. 6, where the housing 48 is shown in axial section, it can be seen that it has roughly a cylindrical shape. Its cylindrical wall 50 delimits, at its rear axial end, a shoulder surface 52 with the internal cylindrical wall 44 of the tubular portion 38. The inside diameter of the internal cylindrical wall 44 is slightly greater than the inside diameter of the housing 48.

The front axial end of the housing 48 is closed by a convex (towards the rear) wall 54 which forms a convergent lens centred on the optical axis A—A.

The particular shape of the frustoconical rear face 56 and of the frustoconical front face 58 of the main body 22 of the optical piece 12 will now be described with reference in particular to FIG. 6.

The frustoconical rear face 56 is stepped radially towards the outside and axially towards the front, here from the front axial end 60 of the tubular portion 38.

The frustoconical rear face 56 is therefore formed by a series of coaxial frustoconical surfaces 62, 64, 66, 68, 70 superimposed axially and connected together by substantially radial and annular surfaces 72, 74, 76, 78.

The generatrix of each frustoconical surface 62, 64, 66, 68, 70 extends in a direction substantially inclined towards the front, that is to say from rear to front and from the optical axis A—A towards the outside.

The mean diameter of each frustoconical surface 62, 64, 66, 68, 70 increases from rear to front.

In the remainder of the description, the frustoconical rear surfaces 62, 64, 66, 68, 70 will be referred to as the reflection faces.

The frustoconical front face 58 of the main body 22 is delimited axially to the rear by a substantially radial and circular central surface 80 which is arranged axially opposite the lens 54. The diameter of the central surface 80 is here substantially equal to the diameter of the lens 54.

From the central surface 80 as far as the front axial end 24 of the optical piece 12, the frustoconical front face 58 is stepped radially towards the outside and axially towards the front. The frustoconical front face 58 is therefore formed by a series of radial annular front surfaces designated by the references 82 to 96.

In the remainder of the description, the annular front surfaces 82 to 96 will be referred to as the exit faces.

The internal edge of each exit face 82 to 96 is connected to the external edge of the radial surface 80 or of the exit face 82 to 96 which is adjacent to it radially by means of a substantially cylindrical surface 98.

Figure 5:
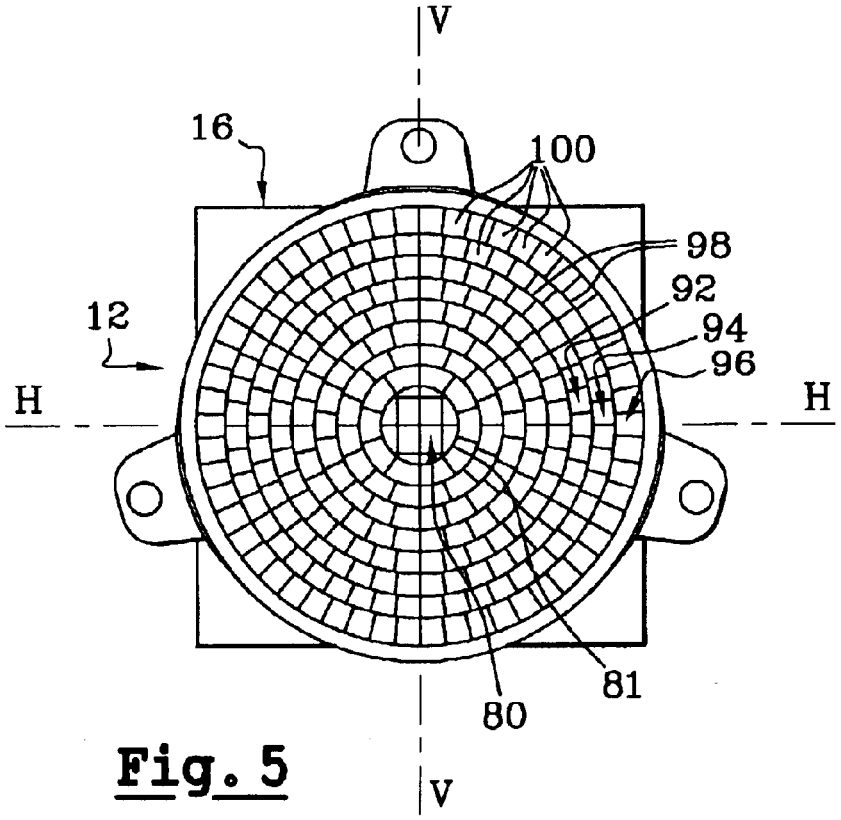
FIG. 5 is a front view which depicts the indicator light of FIG. 1.

Thus, seen from the front, as depicted in FIG. 5, the exit faces 82 to 96 form a series of adjacent concentric rings.

The exit faces 82 to 96 are not flat. They are each formed from a series of adjacent elementary dioptric elements 100, or dioptric patterns.

In the embodiment depicted here, each dioptric element 100 has the shape of an annular ring portion, considering the ring formed by the associated exit face 82 to 96. The dioptric elements 100 of a given exit face 82 to 96 are therefore distributed circumferentially so that they are circumferentially adjacent in pairs.

Figure 3:
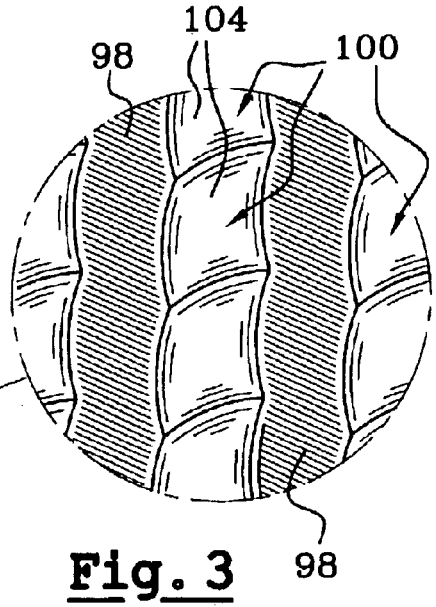
FIG. 3 is an enlarged view of a detail of FIG. 2 which depicts elementary dioptric elements.

As depicted in the detail view in FIG. 3, each dioptric element 100 forms a curved facet, here with a profile roughly concave towards the rear.

Each dioptric element 100 can be assimilated to a dioptre, or prism. In the present embodiment, each dioptric element 100 constitutes a divergent dioptre, because of its concave profile.

Figure 7:
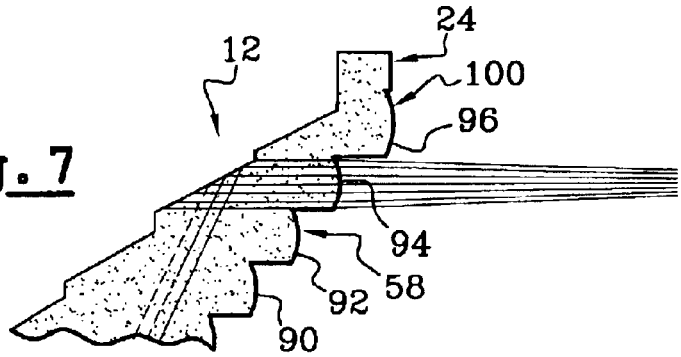
FIG. 7 is a partial view similar to that of FIG. 6 which depicts a variant embodiment of the dioptric elements.

If the variant embodiment depicted in FIG. 7, which is a partial view in axial section of an optical piece 12 according to the teachings of the invention, is considered, it will be noted that each dioptric element 100 can be convex (towards the front) so as to form a convergent dioptre.

In accordance with the teachings of the invention, the concave or curved shape of the surface forming each dioptic element 100 is determined so that light rays, directed towards the front, which reach the rear face 102 of the dioptric element 100 in a direction substantially parallel to the optical axis A—A, emerge through the front face 104 of the dioptric element 100, forming at the front a lighting beam fulfilling the chosen indicating function.

For example, if the indicator light 10 is designed to fulfil a fog light function, then each dioptric element 100 diverts and distributes the light rays which it receives so as to produce at the front, on the measuring screen, an image roughly in the shape of a diamond.

The diamond is not regular, it must have a height along the vertical axis V—V less than its width along the horizontal axis H—H. Therefore, according to the angular orientation of each dioptric element 100, in a radial plane, its concave shape must be optimised so as to make it possible to produce on the measuring screen a shape which approximates the diamond sought here.

Mathematical algorithms make it possible to calculate, by progressive "morphing", the appropriate shape for each dioptric element 100, according to its angular position about the optical axis A—A.

It should be noted that the dioptric elements 100 belonging to different exit faces 82 to 96, and whose angular position with respect to the optical axis A—A is substantially identical, have roughly the same concave shape.

The central surface 80 is also formed by a series of dioptric elements 100, here arranged roughly in the same radial plane.

Unlike the exit faces 82 to 96, the dioptric elements 100 forming the central surface 80 are arranged in a rectangular mesh, here parallel to the vertical axis V—V.

It should be noted that the dioptric elements 100 of the central surface 80 which are adjacent to its circular edge 81 are portions of a rectangle which have an edge in the form of an arc of a circle.

The functioning of the indicator light 10 according to the invention will now be explained, in particular with regard to FIG. 6, which illustrates schematically the path of the light rays emitted by the diode 14.

The whole of the optical system consisting of the diode 14 and the optical piece 12 being roughly of revolution about the optical axis A—A, the optical functioning will be explained only in the axial half-plane which is depicted in FIG. 6.

To facilitate understanding of the invention, only some of the light rays emitted by the diode 14 have been depicted in FIG. 6.

Considering approximately that the diode 14 is a light source at one point, arranged on the optical axis A—A, it is assumed that the light rays are emitted radially, roughly towards the front, from the centre 106 of the hemisphere forming the globe 20.

It should be noted that, the diode 14 being of the high-power type, it has an opening close to 180 degrees, that is to say it emits light rays at a solid angle of 180 degrees.

Amongst the light rays emitted by the diode 14, it can be seen that a major part of these rays impact on the cylindrical wall 50 of the housing 48.

Given the angle of incidence of these light rays on the cylindrical wall 50, it is considered that the major part of the light flux formed by these rays enters inside the body 22 of the optical piece 12 whilst being refracted, in accordance with conventional optical laws.

Naturally, the more the light rays emitted are close to the vertical direction, as seen in FIG. 6, the less they are refracted.

For example, accepting that the diode 14 emits a ray R1 vertically upwards, from its centre 106, and therefore perpendicular to the cylindrical wall 50, then this ray R1 enters the body 22 without deviation.

It should be noted that, so that the optical piece 12 uses the majority of the light flux emitted by the diode 14, it is important that the reflection face 62 closest to the optical axis A—A should extend axially behind the centre 106 of the diode 14, so that the ray Rl, which is the ray furthest to the rear, is reflected towards the front by the said reflection face 62. In the contrary case, the ray R1, and adjacent light rays, would be "lost" inside the body 22, for example by being refracted towards the external wall of the tubular portion 38.

After having passed through the cylindrical wall 50 of the housing, the light rays are refracted so that they "impact" against a reflection face 62 to 70 of the body 22 of the optical piece 22. Arriving on the reflection faces 62 to 70, these light rays are completely reflected towards the front, in accordance with the optical principle of total reflection of the light in a medium with a refractive index greater than that of air. Thus, when a light ray "impacts" on a reflection face 62 to 70 of the body 22, with an angle of incidence sufficiently far away from an orthogonal direction, then it is completely reflected by the said reflection face 62 to 70 without its being necessary for example to deposit a reflective material on the said face 62 to 70.

The inclination of the generatrix of each reflection face 62 to 70 is designed so that the light rays which it receives are reflected towards the front in a direction roughly parallel to the optical axis A—A.

To this end, the angle of inclination of the generatrices of the reflection faces 62 to 70 with respect to the optical axis A—A, in the clockwise direction as seen in FIG. 6, tends to decrease when moving away from the optical axis A—A, radially towards the outside.

Advantageously the generatrix of each of reflection face 62 to 70 is slightly in a convex curve so as to adapt progressively to the angle of incidence of the refracted rays, which changes according to the axial position of its point of incidence on the cylindrical wall 50.

The rays reflected on the reflection faces 62 to 70 are therefore directed towards the front in directions roughly parallel to the optical axis A—A, on the rear face 102 of the dioptric elements 100 forming the exit faces 82 to 96.

The dioptric elements 100 become the light rays so that the light beam emitted towards the front from each dioptric element 100 forms roughly a diamond, in the case of a fog light.

In FIG. 6, the path of the light rays which has just been described is illustrated by the beam F1 and by the beam F2.

It should be noted that the annular radial surfaces 72, 74, 76, 78 are optically neutral surfaces vis-à-vis the transmission of the light rays inside the optical piece 12. This is because the light rays which are refracted inside the body 2, through the cylindrical wall 50, because of their inclinations, cannot reach these annular radial surfaces 72, 74, 76, 78.

The annular radial surfaces 72, 74, 76, 78 are not essential since the frustoconical rear face 56 may not be stepped and thus form only one rear reflection face.

However, the stepping of the reflection faces 62 to 70 makes it possible to increase the outside diameter of the optical piece 12 and therefore the visible light surface which fulfils the indicating function.

This is because, when an indicating function is performed, unlike a front lighting function, the persons in the vehicles following the vehicle equipped with an indicator light 10 according to the invention often have to direct their gaze in the direction of the light source. It is therefore important to minimise the luminance of the light 10 per unit surface area with a view to avoiding dazzling the said persons.

The light ray R2 which passes through the cylindrical wall 50 of the housing 48 close to its front axial end 108 and which constitutes approximately the "last" light ray, as from the rear, to pass through the cylindrical wall 50, preferably determines the minimum axial thickness of the body 22 of the optical piece 12 and its outside diameter.

This is because this light ray R2, when it is refracted inside the body 22, is situated furthest to the front. Consequently it is preferable for the exit faces 82 to 96 to be arranged axially to the front of this ray R2 so that they are not interposed between the ray R2 and the reflection face 70 on which provision is made for it to be reflected. The axial position of the exit faces 82 to 96 partly determines the axial thickness of the body 22.

In addition, the ray R2 is reflected on the reflection face 70 which is radially the most external and axially the furthest to the front. Consequently the ray R2 determines the axial position and the radial position of the front axial end 24 of the radially external reflection face 70 and therefore the outside diameter and the axial depth of the body 22 of the optical piece 12.

In the embodiment depicted here, an axial margin has been left between the ray R2 and the exit faces 82 to 96.

Some of the light rays emitted by the diode 14, those which have the smallest inclination with respect to the optical axis A—A, impact on the lens 54.

This lens 54 here forms a convergent lens which diverts the incoming light rays onto its rear face so that they are refracted inside the body 22 of the optical piece 12 in a direction roughly parallel to the optical axis A—A.

These light rays therefore arrive on the rear faces 102 of the dioptric elements 100 of the central surface 80, parallel to the optical axis A—A, and the dioptric elements 100 spatially distribute the light rays so as to form an image similar to that formed by the dioptric elements 100 on the exit faces 82 to 96.

In FIG. 6, the path of the light rays which enter the body 22 of the optical piece 12 through the lens 54 is illustrated by the beam F3.

The light flux produced at the exit from the optical piece 12 by the beams F1 and F2 may be called the reflected flux since its light rays have undergone a reflection on the reflection faces 62 to 70 of the optical piece 12.

The light flux produced at the exit of the optical piece 12 by the beam F3 may be called the direct flux since its light rays have not undergone any reflection inside the optical piece 12.

The cylindrical wall 48 of the housing 50, the rear reflection faces 62 to 70 and the lens 54 form a light flux recoverer.

The front exit faces 80 to 86 form a light flux distributor.

It should be noted that the indicator light 10 according to the invention optimises the use of novel high-power diodes. This is because the optical piece 12 according to the invention makes it possible to recover the majority of the light flux emitted by the diode 14, so that the diode 14 and the optical piece 12 suffice to satisfy the photometric requirements for fulfilling a regulatory indicating function whilst previously it was necessary to use several diodes in order to obtain sufficient light energy at the exit from the indicator light.

The indicator light 10 according to the invention therefore makes it possible to fulfil a regulatory indicating function with a light of smaller size, which facilitates in particular the arrangement of the light in a vehicle.

However, according to variant embodiments (not shown) of the invention, it is possible to fulfil a given indicating function by means of several optical pieces 12 and several associated low-power diodes.

According to another variant embodiment (not shown) of the invention, the diode 14 can be replaced with a filament lamp. However, this variant requires significantly increasing the size of the optical piece 12, in particular to allow discharge of the heat produced by the filament. In addition, a major part of the light flux emitted by the filament lamp cannot be recovered by the optical piece without the addition of an additional recovery device.

According to yet another variant embodiment (not shown) of the invention, the front exit faces 82 to 96 are not stepped, that is to say the body 22 of the optical piece 12 has only one exit face which forms a round radial surface arranged at the front axial end 24 of the optical piece 12.

The dioptric elements 100 are then all arranged roughly in the same radial plane. These dioptric elements 100 can keep the same arrangement as in the embodiment described above so that the appearance of the optical piece 12 in front view is the same as in FIG. 4, or the dioptric elements 100 can all be arranged in a rectangular mesh.

However, it should be noted that the stepping of the front exit faces 82 to 86, in accordance with the embodiment described with reference to FIGS. 1 to 7, makes it possible to minimise the mean axial thickness of the optical piece 12. This characteristic facilitates the production of the optical piece 12 by moulding with the injection material, in particular because it reduces the quantity of material necessary for producing the optical piece 12.

FIGS. 8 to 11 depict a second embodiment of an indicator light 10 produced in accordance with the teachings of the invention. The indicator light 10 comprises, as in the first embodiment, a high-power light emitting diode 14 which is mounted on a support plate 16 and an optical piece 12 which is mounted on a support (not shown) of the indicator light 10, in front of the diode 14.

Figure 9:
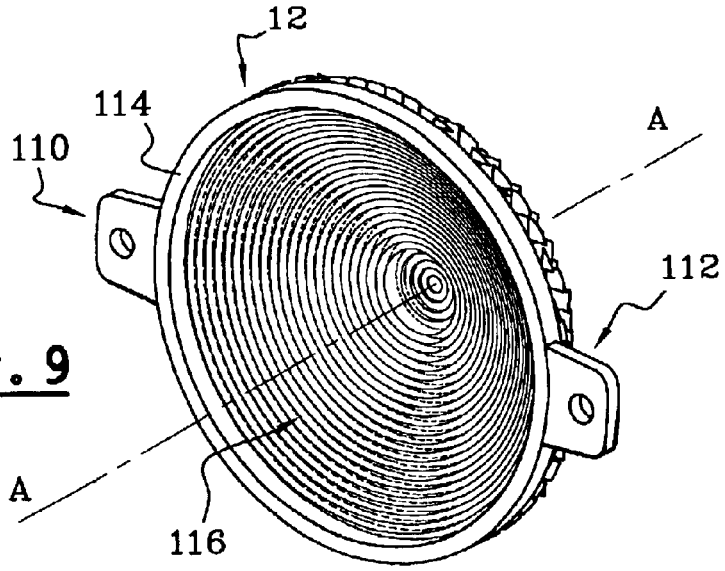
FIG. 9 is a three-quarter rear perspective view which depicts the optical piece of the indicator light of FIG. 8.

As can be seen, in particular in FIG. 9, the optical piece 12 has overall a shape of revolution about the optical axis A—A on which the diode 14 is arranged.

The optical piece 12 has roughly the shape of a spherical cap which is hollowed out at the rear and which comprises here two diametrically opposed support lugs 110, 112, extending in a radial plane from the rear axial end 114 of the optical piece 12.

The support lugs 110, 112 are for example similar to the support portions 34 of the lugs 28, 30, 32 of the optical piece 12 of the first embodiment.

The concave (towards the front) rear face 116 of the optical piece 12 has the form of a flux recoverer of the Fresnel lens type, well known in the prior art. For more information reference can be made in particular to the document FR-A-2.507.741, which describes a flux recoverer of this type.

The rear face 116 therefore has the form of a Fresnel lens, or a stepped lens.

Figures 10, 11:
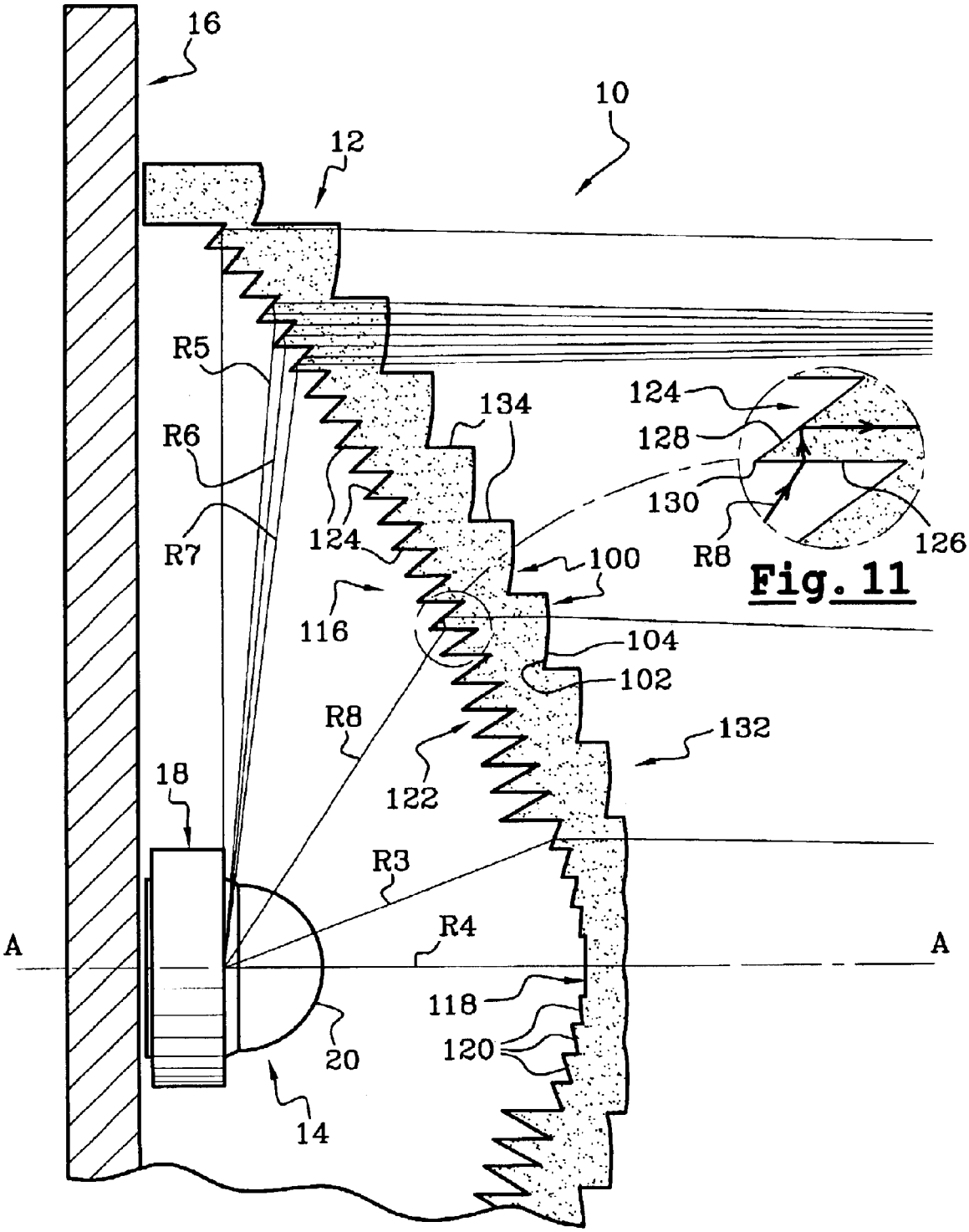
FIG. 10 is a partial enlarged view in axial section, along the cutting plane 10—10 in FIG. 8, which illustrates the path of the light rays emitted by the light-emitting diode of the indicator light of FIG. 8.
FIG. 11 is an enlarged view of a detail of FIG. 10 which depicts the path of a light ray in an annular dioptre belonging to the peripheral part of the rear face of the indicator light of FIG. 8.

As can be seen, in particular in FIG. 10, the rear face 116 comprises here a central part 118 which consists of a series of convergent annular dioptres 120.

The convergent dioptres 120 of the central part 118 are stepped radially towards the outside and axially towards the rear.

They collect the light rays emitted by the diode 14 at a solid angle, centred on the optical axis A—A, having a small opening, for example approximately 60 degrees.

The central part 118 is designed to function in simple refraction, that is to say the light rays which it receives are refracted inside the optical piece 12 and are diverted in a direction substantially parallel to the optical axis A—A.

The central part 118 here has a diameter substantially equal to the diameter of the connection box 18 of the diode 14.

The rear face 116 comprises an annular peripheral part 112 which consists of a series of annular dioptres or prisms 124.

These annular dioptres 124 form a sawtooth profile on the rear face 116.

As can be seen, in particular in FIG. 11, each annular dioptre 124 comprises an internal entry face 126 whose generatrix extends in a direction substantially parallel to the optical axis A—A, and an external reflection face 128 whose generatrix extends in a direction substantially inclined towards the front, from the rear axial end 130 of the entry face 126.

The angle of inclination of the reflection faces 128 with respect to the optical axis A—A preferably increases from the annular dioptres 124 close to the axis A—A towards the annular dioptres 124 remote from the axis A—A, so that the inclination of the reflection faces 128 is adapted to the angle of incidence of the light rays which they receive coming from the diode 14.

The peripheral part 122 is designed to function both in refraction, by collecting the light rays which are refracted on the entry faces 126 of its annular dioptres 124, and in reflection by diverting the light rays in a direction substantially parallel to the optical axis A—A, after they are reflected on the reflection faces 128 of its annular dioptres 124.

In accordance with the teachings of the invention, the front exit face 132 of the optical piece 12 is formed by a series of elementary distribution dioptric elements 100. These dioptric elements 100 are similar to those which were described with reference to the first embodiment.

Each of the dioptric elements 100 has here a convex front surface 104 so as to form a convergent dioptre, as in the variant embodiment depicted in FIG. 7.

The dioptric elements 100 have here a substantially square shape (in front view).

Figure 8:
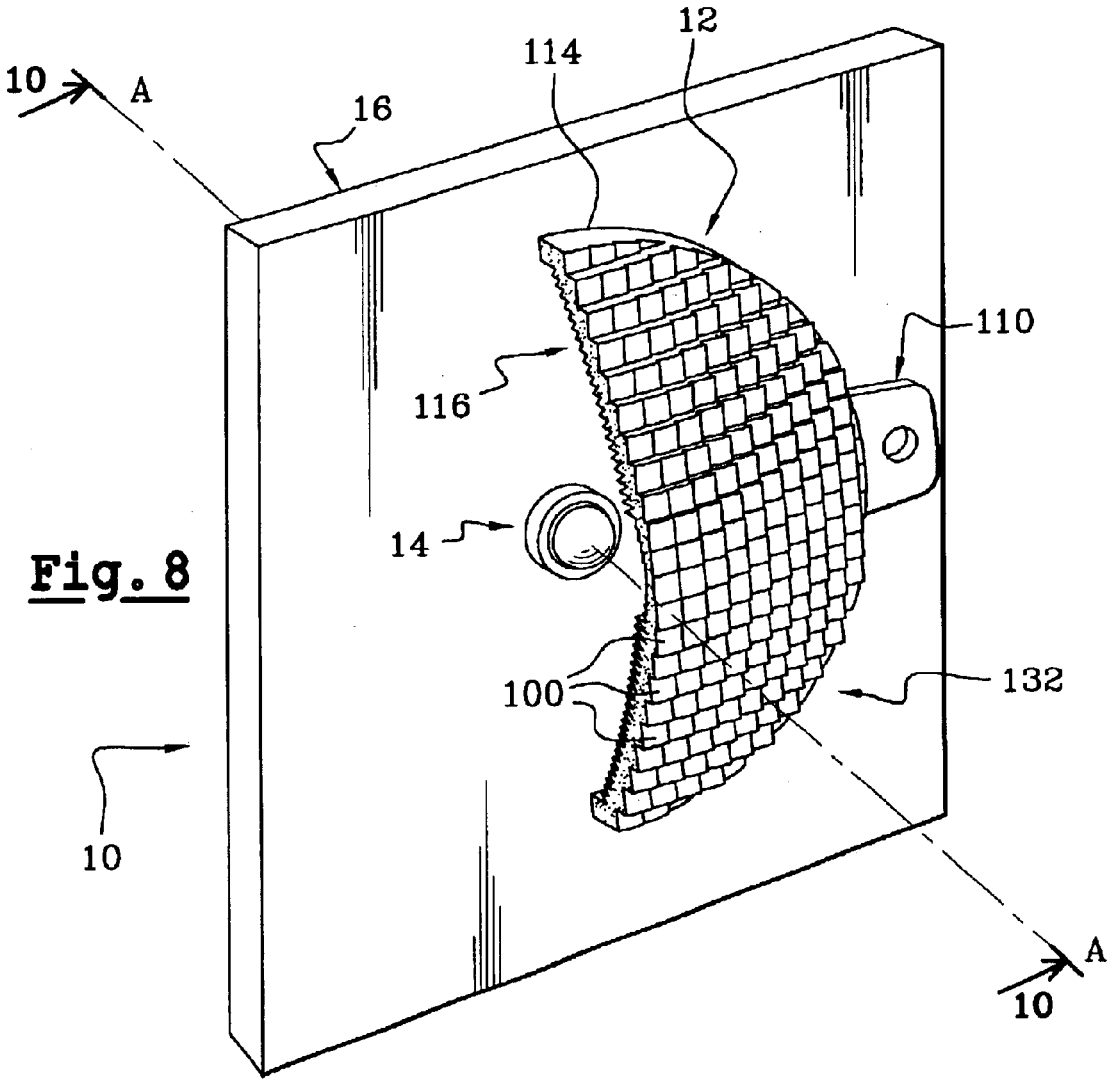
FIG. 8 is a three-quarter front perspective view, with cutaway, which depicts an indicator light according to a second embodiment of the invention.

As can be seen in FIG. 8, the dioptric elements 100 form here a rectangular mesh.

According to one variant embodiment (not shown) of the invention, the dioptric elements 100 can be arranged in rings as in the first embodiment.

The dioptric elements 100 are here stepped radially towards the outside and axially towards the rear, thus forming steps which descend from the optical axis A—A towards the outside and towards the rear.

Each dioptric element 100 is therefore connected to the dioptric element 100 which is radially adjacent to it through a surface 134, here substantially parallel to the axis A—A.

According to another variant embodiment (not shown) of the invention, the front face 132 of the optical piece 12 can be roughly flat, so that all the dioptric elements 100 are contained roughly in the same radial plane. According to this variant, the optical piece 12 then has a roughly cylindrical shape, with a radial front exit face 132 and a concave rear face 136, in the form of a spherical cap.

It should be noted that, in the embodiment depicted here, the dioptric elements 100, which are arranged axially opposite the central part 118, are contained roughly in the same radial plane and thus form a central front exit face 80.

By virtue of the spherical cap shape of the optical piece 12, this surrounds and substantially covers all the globe 20 of the diode 14, so that all the light rays emitted by the diode 14 are recovered by the rear face 116 of the optical piece 12.

The functioning of the indicator light 12 according to the second embodiment of the invention is similar to that which was described in the context of the first embodiment.

The light rays emitted by the diode 14 on the rear face of the central part 118, for example the rays R3 and R4, are refracted inside the optical piece 12 in a direction substantially parallel to the optical axis A—A. Then they reach the rear faces 102 of the facing dioptric elements 100, which distribute them to the front of the indicator light 10, so as to fulfil the required indicating function.

Each of the light rays R5, R6, R7, R8 emitted by the diode 14 on the rear face of the peripheral part 122, for example the ray R8 which is depicted in detail in FIG. 11, will first of all be refracted inside the optical piece 12, passing through the entry face 126 of an annular dioptre 124, and will then be reflected on the associated reflection face 128 of the annular dioptre 124, remaining inside the optical piece 12, so as to be diverted towards the front, in a direction substantially parallel to the optical axis A—A. It then reaches the rear face 102 of a facing dioptric element 100, which distributes it to the front of the indicator light 10, so as to fulfil the required indicating function.

According to a variant embodiment (not shown) of the invention, this second embodiment is able to function with a filament lamp in replacement for the diode 14, subject to increasing the dimensions of the optical piece 12. The dimensions of the optical piece 12 according to the variant are preferably obtained by a homothetic transformation whose ratio is related to the physical differences of the light sources, in particular in order to provide the cooling of the filament lamp.

For example, homothetic transformation is achieved with respect to the centre of the light source, that is to say with respect to the filament for the filament lamp and with respect to the centre 106 of the globe 20 for the diode 14, and the coefficient of the transformation matrix adopted is three, for the change from the diode 14 to the filament lamp.

It should be noted that, for the two embodiments described above, the circular shape of revolution of the optical piece 12 is the optimum shape which makes it possible to recover the majority of the light flux emitted by the diode 14.

Other shapes can nevertheless be used for the optical piece 12, for example an ellipse shape or a rectangular shape, in front view or rear view.

In the indicator light 10 according to the invention, the optical piece 12 is "autonomous" at the optical level, that is to say it fulfils the indicating function by itself without its being necessary to add a reflector and/or a diffusion glass. The optical piece 12 according to the invention effects both the recovery of the light rays emitted by the source 14 and the distribution of the light rays to the front so as to fulfil the chosen indicating function.

Naturally the indicator light 10 according to the invention can be arranged inside a casing comprising an external protective glass, for example in a casing which groups together all the indicator lights associated with the various regulatory functions.

What is claimed is:

1. An indicator light, in particular for a motor vehicle, of the type comprising a central optical axis oriented from rear to front, a light source roughly at one point disposed on this optical axis, and a solid optical piece, at least partly of revolution about the optical axis, which is produced from a transparent material with a refractive index greater than that of air, and which is arranged at the front of the source, of the type in which the optical piece comprises at least:

an input face whose generatrix lies in a direction substantially parallel to the optical axis;

a rear reflection face whose generatrix lies in a direction substantially inclined towards the front;

and a front exit face;

so that the light flux emitted by the source and entering the optical piece through the input face is reflected on the rear reflection face, according to the principal of total reflection, and is returned towards the front exit face in a direction roughly parallel to the optical axis, with a view to fulfilling a given indicating function, wherein the exit face is formed by a series of elementary distribution dioptric elements, each of which has at least a curved surface and is designed to form an elementary light beam whose image, on a screen placed in front of the indicator light, corresponds to the indicating function to be fulfilled.

2. The indicator light according claim 1, wherein each elementary dioptric element extends roughly in a radial plane, and in that the elementary dioptric elements form a mesh.

3. The indicator light according to claim 1, wherein the dioptric elements are arranged in rings around the optical axis, and in that each dioptric element extends over an angular ring portion.

4. The indicator light according to claim 1, wherein the optical piece comprises several rear reflection faces which are stepped axially and radially.

5. The indicator light according to claim 1, wherein the optical piece comprises several entry faces which are stepped axially towards the rear and radially from the optical axis towards the outside.

6. The indicator light according to claim 1, wherein the optical piece comprises a central portion, at least partly of revolution about the optical axis, which is arranged axially to the front of the light source and which comprises at least one rear entry face which is designed to divert the incoming light flux, according to the refraction principle, in order to return it, in a direction substantially parallel to the optical axis, to a central front exit face associated with the optical piece, designed to form a light beam corresponding to the indicating function to be fulfilled.

7. The indicator light according to claim 6, wherein at least one part of the central portion is a lens.

8. The indicator light according to claim 1, wherein the optical piece comprises a substantially cylindrical rear housing coaxial with the optical axis in which the light source is arranged.

9. The indicator light according to claim 8, wherein the optical piece comprises several annular rear reflection faces which are stepped axially towards the front and radially from the optical axis towards the outside, two adjacent rear reflection faces being separated by an optically neutral annular rear face arranged outside the path of the light flux which has just been reflected on the said rear reflecting faces.

10. The indicator light according to claim 9, wherein the optical piece comprises several annular front exit faces which are stepped axially towards the front and radially from the optical axis towards the outside.

11. The indicator light according to claim 1, wherein the rear face of the optical piece has roughly the shape of a spherical cap centered on the optical axis.

12. The indicator light according to claim 1, wherein the light source is a light-emitting diode.

13. The indicator light according to claim 1, wherein the optical piece is produced in a single piece, in particular by plastic moulding.

14. The indicator light according to claim 1, wherein the curved elementary distribution dioptric elements have a concave surface.

15. The indicator light according to claim 1, wherein the curved elementary distribution dioptric elements have a convex surface.

* * * * *